US011296432B2

(12) United States Patent
Moll et al.

(10) Patent No.: US 11,296,432 B2
(45) Date of Patent: Apr. 5, 2022

(54) ELECTRICAL TERMINAL FOR FLAT FLEXIBLE CABLES

(71) Applicant: TE Connectivity Services GmbH, Schaffhausen (CH)

(72) Inventors: Hurley Chester Moll, Hershey, PA (US); John Mark Myer, Millersville, PA (US); Forrest Irving Kinsey, Jr., Harrisburg, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/919,855

(22) Filed: Jul. 2, 2020

(65) Prior Publication Data

US 2022/0006207 A1 Jan. 6, 2022

(51) Int. Cl.

| | |
|---|---|
| ***H01R 4/2495*** | (2018.01) |
| ***H01R 12/68*** | (2011.01) |
| ***H01R 12/81*** | (2011.01) |
| ***H01R 13/42*** | (2006.01) |
| ***H01R 12/67*** | (2011.01) |

(52) U.S. Cl.

CPC ..... *H01R 4/2495* (2013.01); *H01R 12/675* (2013.01); *H01R 12/68* (2013.01); *H01R 12/81* (2013.01); *H01R 13/42* (2013.01)

(58) Field of Classification Search

CPC .... H01R 4/2495; H01R 12/675; H01R 12/68; H01R 12/81; H01R 13/42

USPC ..... 174/84 C

See application file for complete search history.

(56) References Cited

U.S. PATENT DOCUMENTS

| | | | | | |
|---|---|---|---|---|---|
| 3,696,322 | A * | 10/1972 | Spangler | H01R 4/2406 | 439/423 |
| 3,697,925 | A * | 10/1972 | Henschen | H01R 12/69 | 439/494 |
| 3,916,085 | A * | 10/1975 | Hansen | H01R 4/2495 | 174/84 C |
| 3,924,923 | A * | 12/1975 | Shoemaker | H01R 43/01 | 439/894 |
| 3,990,143 | A * | 11/1976 | Dittmann | H01R 4/188 | 29/865 |
| 4,142,771 | A * | 3/1979 | Barnes | H01R 4/184 | 174/84 C |

(Continued)

*Primary Examiner* — Timothy J Thompson
*Assistant Examiner* — Michael F McAllister

(57) ABSTRACT

A cable assembly includes a flat flexible cable having a plurality of conductors embedded within an insulation material. A portion of each of the conductors is exposed via openings selectively formed in the insulation material, allowing for a crimping portion of an electrically conductive terminal to engage with the conductor within the opening. The crimping portion of the terminal includes a base defining at least one protrusion extending therefrom, and first and second sidewalls extending from the base. The base and the first and second sidewalls define an opening configured to receive the conductor therein. The first sidewall includes a first section attached to the base and a second section attached to the first section on an end opposite the base. In a crimped state of the terminal, the first sidewall rotated into the opening such that the first section at least partially surrounds the second section, and the second sidewall is rotated in a direction opposite the first section such that the first section at least partially surrounds the second section, for crimping the conductor within the opening and against the protrusion.

20 Claims, 4 Drawing Sheets

(56) References Cited

U.S. PATENT DOCUMENTS

| | | | | |
|---|---|---|---|---|
| 5,561,267 | A * | 10/1996 | Fudoo | H01R 4/185<br>174/84 C |
| 6,232,555 | B1 * | 5/2001 | Besler | H01R 4/182<br>174/84 C |
| 7,316,581 | B2 * | 1/2008 | Kumakura | H01R 4/182<br>439/422 |
| 7,581,979 | B2 * | 9/2009 | Kumakura | H01R 4/185<br>174/117 FF |
| 9,397,410 | B2 * | 7/2016 | Corman | H01R 4/185 |
| 10,003,136 | B2 * | 6/2018 | Ohnuma | H01R 43/048 |

* cited by examiner

ELECTRICAL TERMINAL FOR FLAT FLEXIBLE CABLES

FIELD OF THE INVENTION

The present disclosure relates to electrical terminals, and more particularly, to electrical terminals suitable for crimping to conductors of a flat flexible cable.

BACKGROUND

As understood by those skilled in the art, flat flexible cables (FFCs) or flat flexible circuits are electrical components consisting of at least one conductor (e.g., a metallic foil conductor) embedded within a thin, flexible strip of insulation. Flat flexible cables are gaining popularity across many industries due to advantages offered over their traditional "round wire" counter parts. Specifically, in addition to having a lower profile and lighter weight, FFCs enable the implementation of large circuit pathways with significantly greater ease compared to a round wire-based architectures. As a result, FFCs are being considered for many complex and/or high-volume applications, including wiring harnesses, such as those used in automotive manufacturing.

The implementation or integration of FFCs into existing wiring environments is not without significant challenges. In an automotive application, by way of example only, an FFC-based wiring harness would be required to mate with perhaps hundreds of existing components, including sub-harnesses and various electronic devices (e.g., lights, sensors, etc.), each having established, and in some cases standardized, connector or interface types. Accordingly, a critical obstacle preventing the implementation of FFCs into these applications includes the need to develop quick, robust, and low resistance termination techniques which enable an FFC to be connectorized for mating with these existing connections.

A typical FFC may be realized by applying insulation material to either side of a pre-patterned thin foil conductor, and bonding the sides together via an adhesive to enclose the conductor therein. Current FFC terminals include piercing-style crimp terminals, wherein sharpened tines of a terminal are used to pierce the insulation and adhesive material of the FFC in order to attempt to establish a secure electrical connection with the embedded conductor. However, due in part to the fragile nature of the thin foil conductor material, these types of terminals have several drawbacks, including much higher electrical resistances compared to conventional round wire F-crimps, inconsistent electrical connectivity between the conductor and the terminal, and mechanical unreliability over time in harsh environments.

Accordingly, there is a need for improved electrical terminals and accompanying termination techniques for adapting FFCs to these environments.

SUMMARY

According to an embodiment of the present disclosure, a terminal for mating with an exposed conductor of a flat flexible cable is provided. The terminal includes an electrical contact and a crimping portion extending from the electrical contact in a longitudinal direction of the terminal for crimping to the conductor of the flat flexible cable. The crimping portion comprises a base defining at least one protrusion extending therefrom, and first and second sidewalls extending from the base. The first sidewall includes a first section attached to the base and a second section attached to the first section on an end opposite the base. The base and sidewalls define an opening configured to receive the conductor of the flat flexible cable therein. In a crimped state of the terminal, the first sidewall wound or rotated in a first direction and into the opening such that the first section at least partially surrounds the second section for crimping the conductor within the opening and against the protrusion, and the second sidewall is wound or rotated in a direction opposite the first section such that the first section at least partially surrounds the second section of the second sidewall.

A cable assembly according to an embodiment of the present disclosure includes a flat flexible cable having a plurality of conductors embedded within an insulation material. A portion of each of the conductors is exposed via openings selectively formed in the insulation material, allowing for a crimping portion of an electrically conductive terminal to engage with the conductor within the opening. The crimping portion of the terminal includes a base defining at least one protrusion extending therefrom, and first and second sidewalls extending from the base. The base and the first and second sidewalls define an opening configured to receive the conductor therein. The first sidewall includes a first section attached to the base and a second section attached to the first section on an end opposite the base. In a crimped state of the terminal, the first sidewall wound about itself and generally into the opening such that the first section at least partially surrounds the second section for crimping the conductor within the opening and against the protrusion, and the second sidewall is rotated or wound in a direction opposite that of the first section such that the first section at least partially surrounds the second section.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
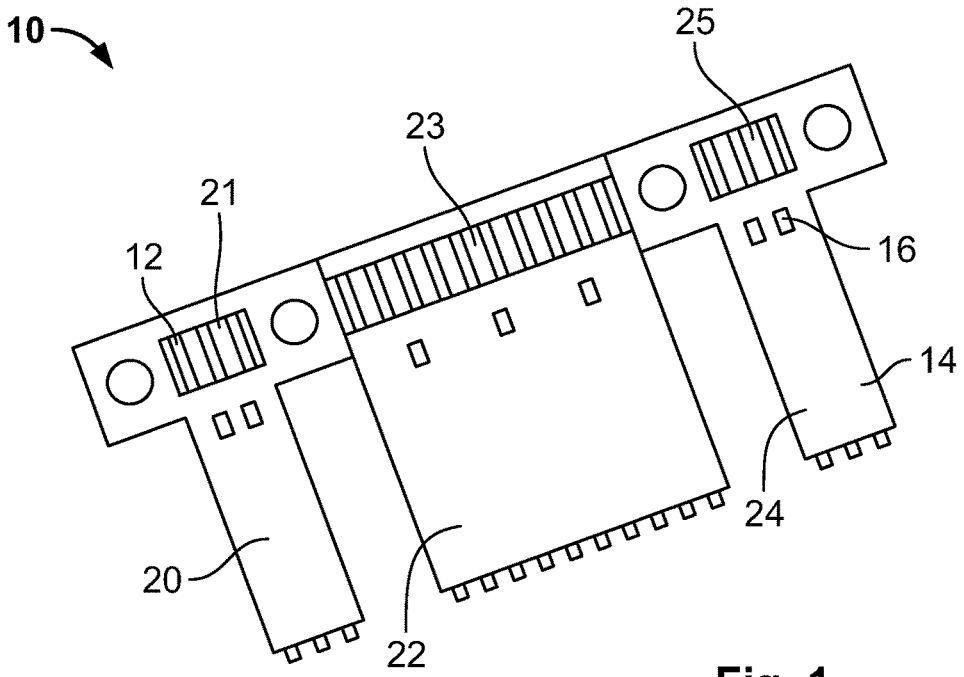
FIG. 1 is a top view of an exemplary FFC configured for use with terminals according to embodiments of the present disclosure.

Exemplary embodiments of the invention will be described hereinafter in detail with reference to the attached drawings, wherein like reference numerals refer to like elements. The invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Reliably crimping a terminal onto a thin conductor of an FFC requires a means to address the risks of either failing to make suitable (or any) electrical contact with the conductor, or damaging the conductor via the application of excess pressure. This has proven difficult to achieve, in part due to the thin nature of the conductors of the FFC compared to the tolerances of typical crimp-style terminals. For example, with a thickness of less than a tenth of a millimeter (mm) (e.g., 0.07 mm), crimping height tolerances can easily exceed the thickness of the conductor, which may result in either a complete lack of electrical contact between the terminal and the conductor, or the crushing and destruction of the conductor, despite a proper crimping operation. As will be set forth in greater detail herein, embodiments of the present disclosure aim to address these difficulties, providing crimpable terminals that enable reliable, low-resistance connections to be realized in mass termination or crimping operations.

Terminals according to embodiments of the present disclosure may be configured for use with an FFC, such as the exemplary portion of an FFC 10 shown in FIG. 1. As illustrated, the FFC 10 generally includes a plurality of conductors 12 embedded within an insulation material 14. The conductors 12 may comprise metallic foil, such as copper foil on the order of 0.07 mm in thickness, by way of example only, patterned in any desirable configuration. The insulation material 14, such as a polymer insulation material, may be applied to either side of the conductors 12 via an adhesive material, resulting in an embedded conductor arrangement. The exemplary FFC 10 includes multiple segments 20,22,24, each containing a plurality of conductors 12. Respective windows or openings 21,23,25 are selectively formed or defined proximate respective ends of the segments 20,22,24 for exposing the conductors 12, enabling connectorization thereof utilizing terminals according to embodiments of the present disclosure. Windows or openings may be formed in the insulation material 14 in any desired location in order to expose portions of the conductors 12 for facilitating termination. Additional openings 16 may be provided, and configured to accept complementary features of associated connectors, as will be described in further detail herein.

Figure 2:
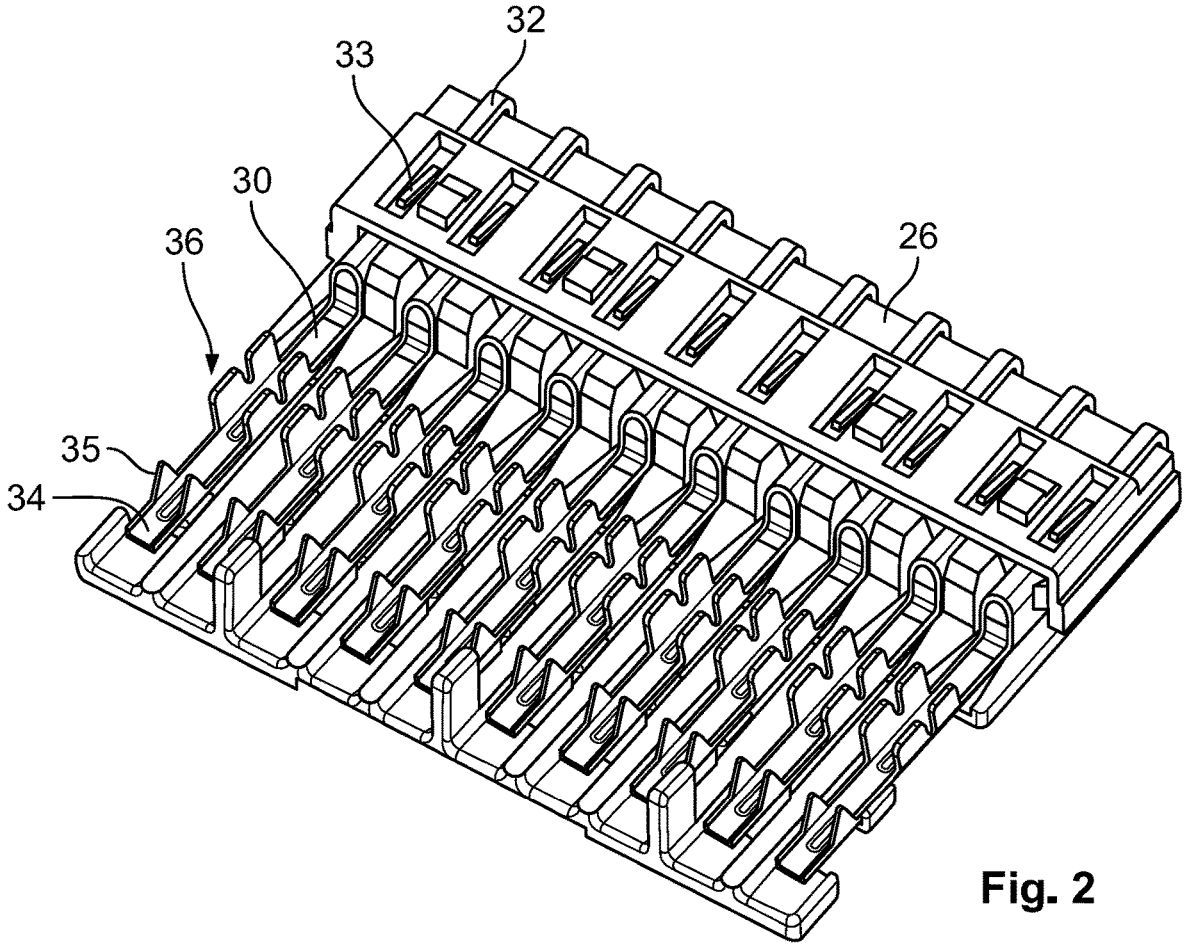
FIG. 2 is a perspective view of a plurality of terminals according to embodiments of the present disclosure installed in an exemplary connector body.

With reference to FIG. 2, an exemplary inner housing 26 forming a part of a connector is provided for fixing to the FFC 10 of FIG. 1, by way of example only. As shown, the inner housing 26 is pre-fitted with a plurality of conductive terminals 30 according to embodiments of the present disclosure. Each terminal 30 generally includes an electrical contact or mating end 32, in this case, a female mating end configured to receive a corresponding male terminal for establishing an electrical connection. The mating end 32 may comprise one or more locking features 33 configured to engage with the inner housing 26 for securing the terminal 30 thereto. A rear end 34 of the terminal 30 opposite the mating end 32 may include piercing elements 35, embodied herein as a pair of sharpened tines. Arranged between the mating end 32 and the rear end 34 is a crimping portion 36 configured to be plastically deformed to crimp onto a conductor arranged therein.

Figure 3:
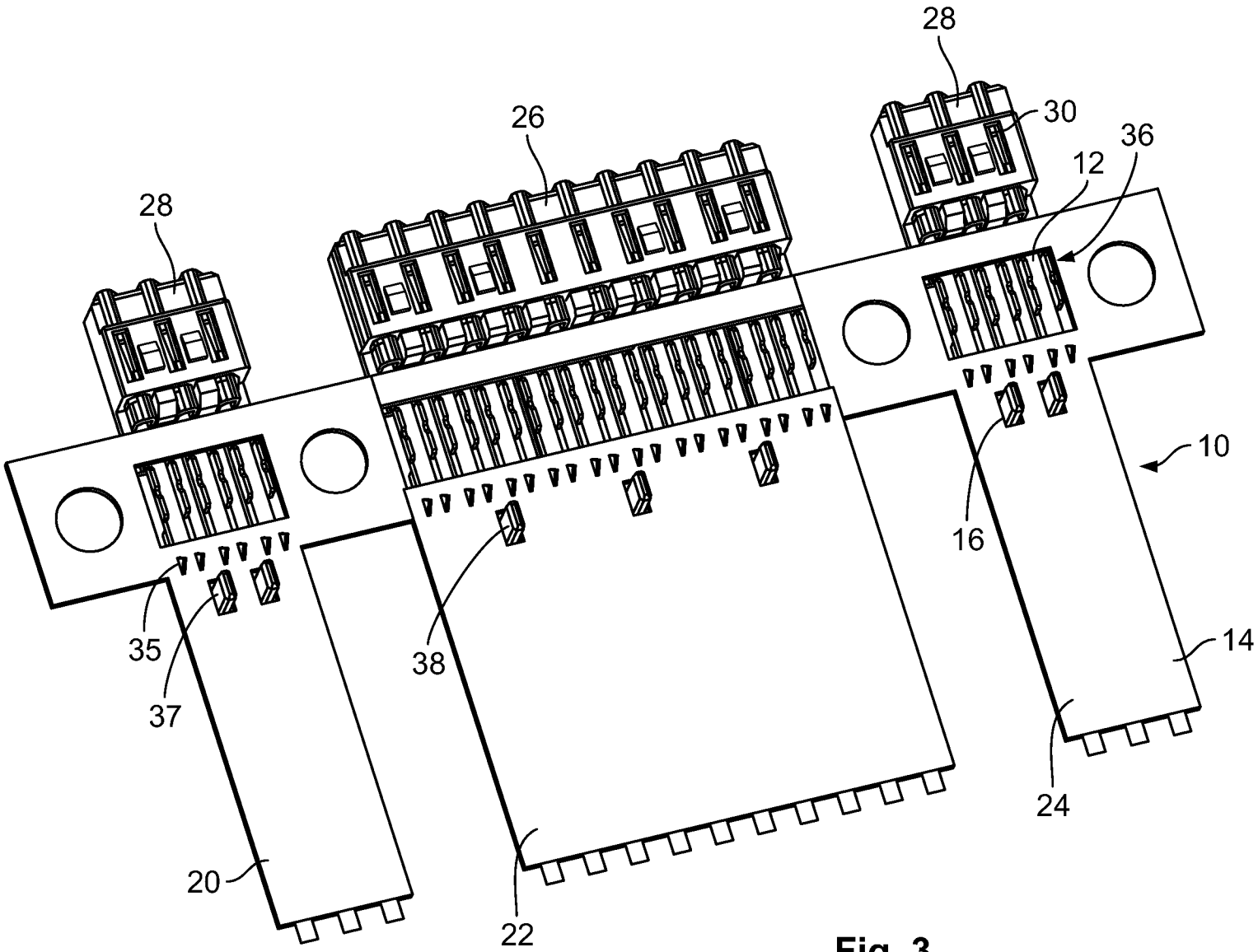
FIG. 3 is a perspective view of the FFC of FIG. 1 being mated with the terminals and connector body of FIG. 2.

FIG. 3 illustrates an intermediate step in a connectorization process of the FFC 10. As shown, the FFC 10 is placed over a plurality of connectors, including inner housing 26 of FIG. 2, as well as two second inner housings 28. The terminals 30 of each of the connectors receive the exposed conductors 12 within respective crimping portions 36 thereof which extend through the windows 21,23,25 (see FIG. 1) formed in the insulation material 14 of the FFC 10. The crimping portions 36 are configured to be crimped onto the conductors 12, for example, in a mass termination or crimping step wherein the crimping portions 36 of each of the terminals 30 is crimped simultaneously, securing the terminals 30, and thus the inner housings 26,28 to the FFC 10. The inner housings 26,28 may further define strain relief portions 37,38 configured to extend through the openings 16 in the FFC 10, which are used to further secure the inner housings 26,28 to the FFC 10. Likewise, as shown, the piercing elements 35 penetrate the insulation material 14 of the FFC 10, and may be flattened or otherwise deformed thereafter for further securing the terminal 30 to the FFC 10. In this way, the piercing elements 35 and the strain relief portions 37,38 provide forms of strain relief for the resulting connection, mechanically fixing the position of the FFC 10 relative to the terminals 30.

Figure 4A:
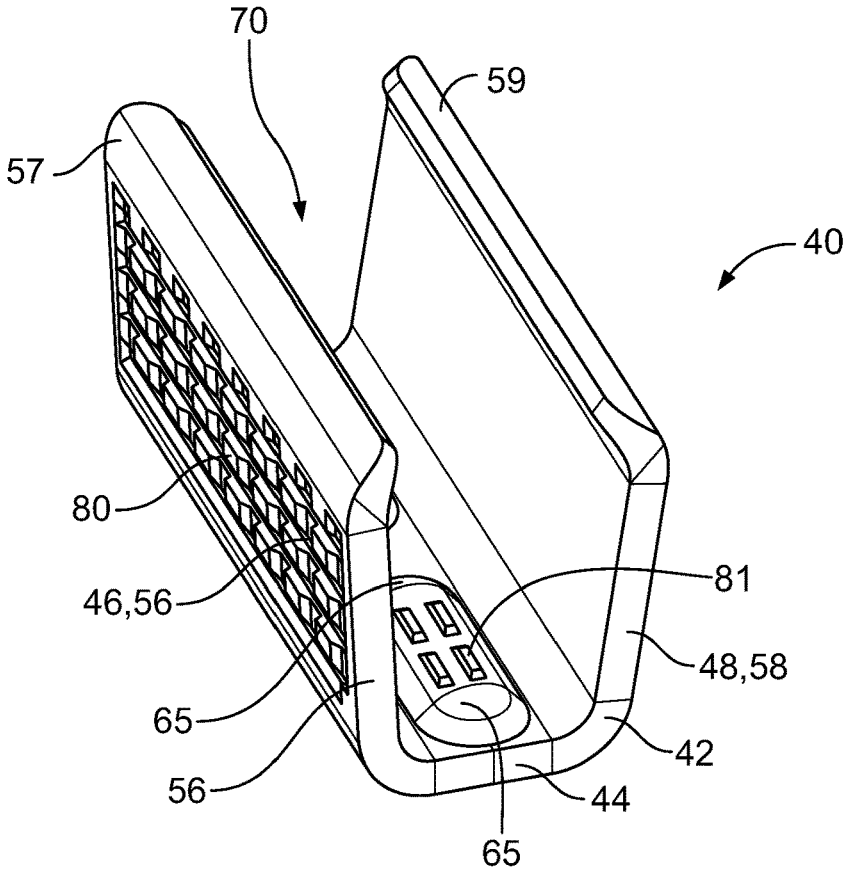
FIG. 4A is a perspective view of a crimping portion of a terminal according to a first embodiment of the present disclosure in an uncrimped state.
Figure 4B:
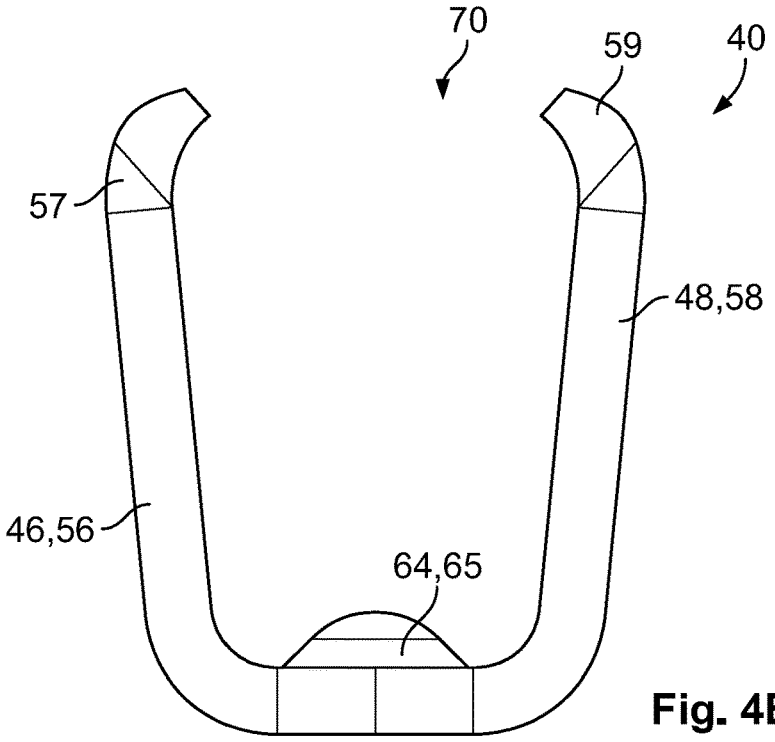
FIG. 4B is a front cross-sectional view of the crimping portion of FIG. 4A.
Figure 4C:
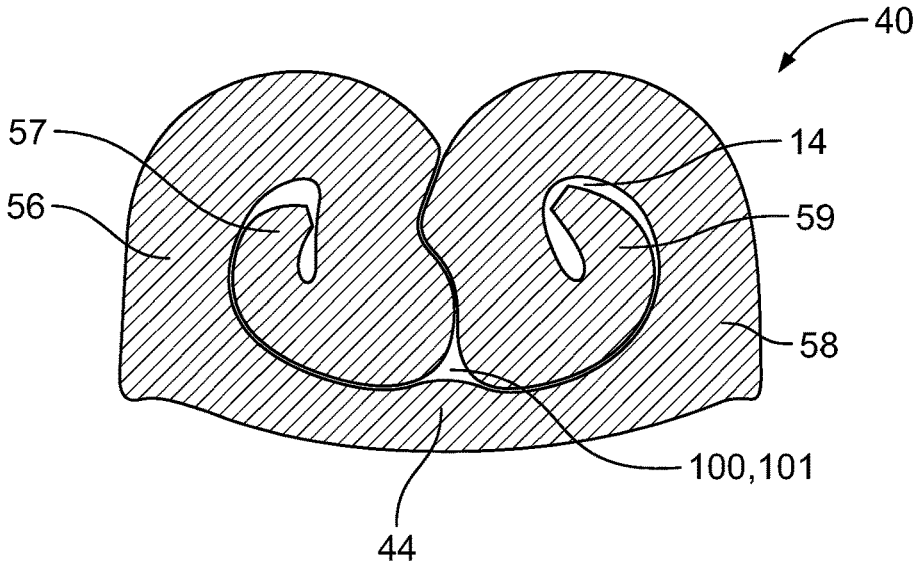
FIG. 4C is a front cross-sectional view of the crimping portion of FIGS. 4A and 4B in a crimped state.

FIGS. 4A-4C illustrate an embodiment of a crimping portion 40 of a terminal (e.g., terminal 30 of FIGS. 2 and 3) configured for use with an FFC according to the present disclosure, with a remainder of the terminal not shown. Referring to FIGS. 4A-4C, in an uncrimped state, the crimping portion 40 comprises a generally U-shaped body 42, including a base 44 and two generally opposing sidewalls or wings 46,48 extending from either side thereof in a direction generally perpendicularly from the base 44. A contact or conductor receiving opening or space 70 is defined between the sidewalls 46,48 and is configured to receive an exposed conductor of an FFC (e.g., conductor 12 shown in FIGS. 1 and 3) therein along an axial direction of the terminal. Each sidewall or wing 46,48 may be defined by two sections. Specifically, the first sidewall 46 comprises a first section 56 extending from and adjoining the base 44, and a second section 57 extending from the first section. As shown in FIG. 4B, in the uncrimped state, the first and second sections 56,57 may extend in different directions relative to the base 44. More specifically, the first section 56 may extend generally perpendicularly from the base 44, or in the illustrated embodiment, angled in a direction generally away from a center of the crimping portion 40. The second section 57 comprises a curved end portion extending along the length of the sidewall 46 and having an axis of curvature oriented in the longitudinal direction of the terminal. In this way, the curved end portion of the second section 57 defines an outer convex surface and an inner concave surface. The curved end portion of the second section 57 may also taper in thickness from the end of the first section 56, to a free end thereof, with the free end extending in a direction of the receiving opening. Likewise, the second sidewall 48 comprises first and second sections 58,59, each having features similar to those set forth above with respect to the first sidewall 46, the details of which will not be repeated.

The angled and/or curved nature of the first sections 56,58 and the second sections 57,59 facilitates a crimping operation which includes a winding, rolling or curling of each of the sidewalls. More specifically, referring to FIG. 4C, the crimping portion 40 is shown in a crimped state, wherein each of the opposing sidewalls 46,48 have been crimped in a wrapped winding manner from the orientation shown in FIGS. 4A and 4B. As illustrated, the first and second sections 56,57 of the first sidewall 46 having been deformed in a radial or spiraled fashion, wherein the second section is rolled or curled into the receiving opening 70 in a generally clockwise manner. As shown, the free end of the second section 57 may be rolled through at least approximately 270 degrees of rotation about an axis extending longitudinally along a length of the terminal, and preferably though approximately 360 degrees of rotation, such that its angular orientation relative to the base 44 in the crimped state is generally equal to its angular orientation prior to the crimping operation. In this way, the first section 56 generally surrounds the second section 57 arranged therewithin. The second sidewall 48 is deformed in a similar fashion to the first sidewall 46, wherein the second section 59 thereof is wound within the first section 58, such as the first section generally surrounds the second section.

The sidewalls 46,48 may be deformed or crimped simultaneously, allowing for faster termination compared to multi-step crimping processes of other terminal types. In one particularly advantageous embodiment, deformation of the first and second sidewalls 46,48 in the rolled or spiraled manner may be performed during an initial step of a crimping process, and prior to the sidewalls 46,48 engaging with a conductor arranged within the receiving opening 70. In this way, the orientation or arrangement of the conductor within the opening 70 is unaffected by the initial sidewall deformation process, and potential damage (e.g. tearing) of the fragile conductor is avoided. Once the rolled sidewalls are formed, one or more subsequent crimping operations or motions includes urging or pressing the rolled sidewalls 46,48 toward the base 44 and into engagement with the conductor. More specifically, and still referring to FIG. 4C, in the crimped state, a conductor 100 is crimped within a resulting space 101 of the receiving opening defined between a respective side of each of the first and second sidewalls 46,48 (i.e., an exterior side of the crimping portion in the uncrimped state) and the base 44.

Referring again to FIG. 4A, the illustrated exterior sides of the first and second sidewalls 46,48 may include serrations or serrated sections 80 formed or defined thereon. The serrations 80 may be positioned on the sidewalls 46,48 so as to generally abut or engage with a conductor arranged within the opening 70 in the crimped state of the terminal as shown in FIG. 4C. In addition to improving electrical engagement or electrical contact with the conductor, the serrations 80 may prevent the conductor from being displaced relative to an ideal position within the opening 70 during the crimping process. Similar serrations or serrated sections 81 defining a pattern of raised protrusions or teeth may be formed on the base 44, including on raised features thereof as set forth in detail below.

As set forth above, reliably crimping to a thin conductor of an FFC requires a means to address the risks of either failing to make suitable electrical contact with the conductor, or damaging the conductor via the application of excess pressure. Embodiments of the present disclosure address this problem via the introduction of several additional features onto or into the base 44 of the crimping portion 40 to prevent either of the above failures.

Still referring to FIGS. 4A-4C, the crimping portion 40 includes axially-extending protrusions 64 rising into the receiving opening 70 from the base 44, only one of which is shown in FIG. 4A. A second corresponding protrusion, having features similar to those of illustrated protrusion 64, is arranged on an opposite end of the crimping portion 40 and is aligned with the illustrated protrusion 64 along the axial direction of the terminal. The protrusion(s) 64 comprises an outer curved or rounded profile having an axis of curvature aligned generally parallel with an axial direction of the terminal and/or the conductor to be arranged therein. The protrusion 64 further defines two rounded ends 65 extending in respective axial directions. Due in part to this curved nature, the protrusion(s) 64 are configured (i.e., are sized and shaped) so as to compress a conductor under force from the crimped first and second sidewalls 46,48 in a manner which will prevent damage thereto. Moreover, the added height of the protrusions ensures that reliable electrical contact is always achieved with the conductor, addressing the above-described tolerance-related issues with crimping solutions of the prior art. Further, the height of the protrusions may be selected so as to allow for crimp height and compressive force adjustments for a given application (e.g., for different thicknesses of conductors).

The base 44 may comprise serrated sections 81 formed therein, for example, serrations formed on the surface of the protrusion(s) 64. In addition to improving electrical contact with a conductor arranged within the opening 70 in the crimped state of the terminal, the serrated sections 81 of the base 44 act to hold the a conductor in position within the opening 70, preventing unwanted displacement thereof during, for example, a crimping operation performed on the sidewalls 46,48 of the terminal.

Figure 5:
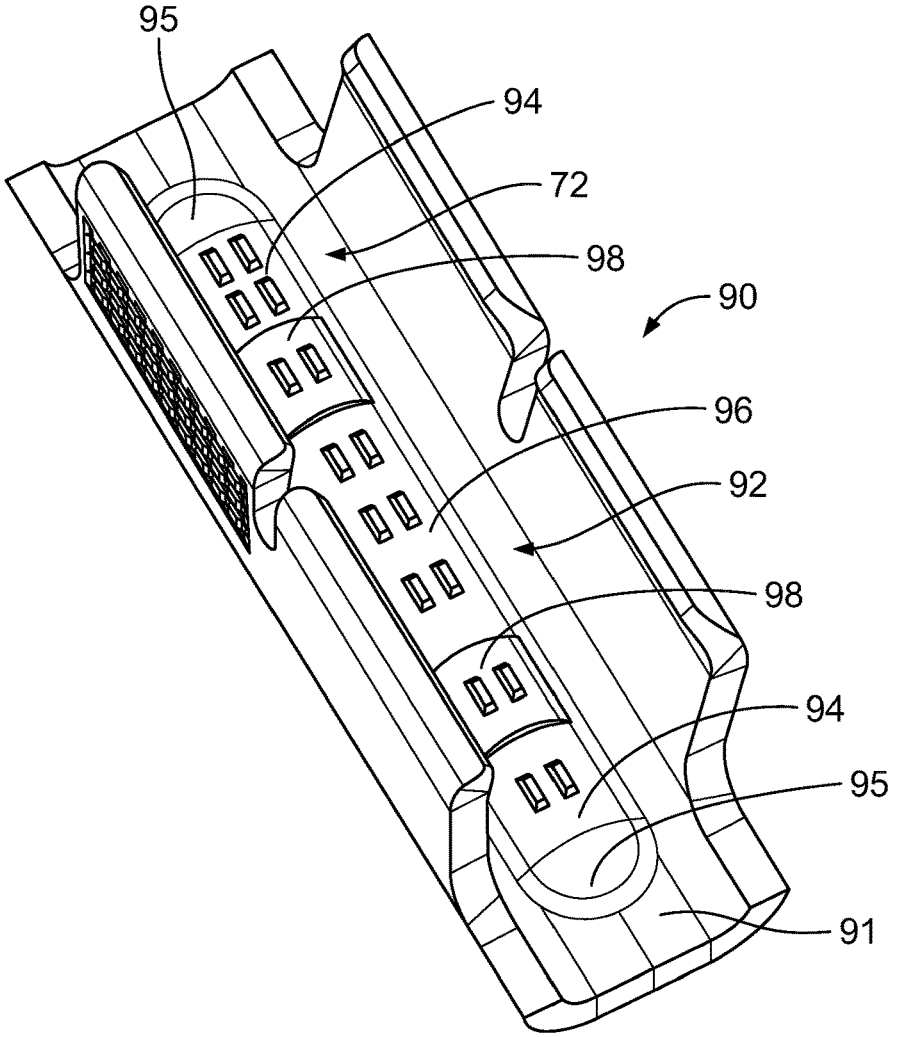
FIG. 5 is a perspective view of a crimping portion of a terminal according to a second embodiment of the present disclosure.

Another embodiment of a crimping portion 90, as shown in FIG. 5, includes an axially-extending protrusion 92 rising into the receiving opening 72 from a base 91. In the illustrated embodiment, the protrusion 92 includes a plurality of segments, including a pair of outer compression limiters 94 defined by raised protrusions extending from the base 91 in a vertical direction into the receiving opening 72. Likewise, a central compression limiter 96 is defined by a protrusion extending generally between the outer compression limiters 94. Each of the compression limiters 94,96 comprises an outer curved or rounded profile having an axis of curvature aligned generally parallel with an axial direction of the terminal and/or the conductor to be arranged therein. The outer compression limiters 94 also comprise rounded ends 95 extending in respective axial directions. As shown, at least a portion of each of the outer compression limiters 94 extends in an axial direction beyond an end of the first and second sidewalls, ensuring maximum contact area with a conductor crimped within the terminal. The sidewalls of the illustrated embodiment comprise features similar to those set forth above with respect to FIGS. 4A-4C and will not be described in further detail herein.

Still referring to FIG. 5, the protrusion 92 further comprises protruding sections or pushers 98 formed between the outer compression limiters 94 and the central compression limiter 96. Each protruding section 98 may also comprise a curved or rounded profile extending into the receiving opening 72 and having an axis of curvature oriented parallel to the axial direction of the terminal. In one embodiment, the protruding sections 98 are taller than the compression limiters 94,96, and thus extend further vertically into the receiving opening or space 72. Each protruding section 98 defines at least two edges on a top surface of the protrusion 92 that extend in a direction transverse to the axial direction of the terminal, and aid in securing and electrically contacting a conductor arranged within the receiving opening in the crimped state of the terminal. Despite the variation in height, the protruding sections 98 and the compression limiters 94,96 create a generally continuous rounded protrusion 92 extending axially within the receiving opening 72.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range. For example, it should also be understood that embodiments of the present disclosure may include any combination of the above-described features, such as various combinations of compression limiters and spring arrangements, and are not limited to the exemplary arrangements set forth in the figures.

Also, the indefinite articles "a" and "an" preceding an element or component of the invention are intended to be nonrestrictive regarding the number of instances, that is, occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as described in the application.

What is claimed is:

1. An electrical terminal for mating with an exposed conductor of a flat flexible cable, comprising:

an electrical contact; and a crimping portion extending from the electrical contact in a longitudinal direction of the terminal for crimping to the conductor of the flat flexible cable, the crimping portion including:

a base defining at least one protrusion extending along the base in the longitudinal direction of the terminal;

a first sidewall extending from the base and comprising a first section attached to the base and a second section attached to the first section on an end opposite the base; and a second sidewall extending from the base, wherein the base and the first and second sidewalls define an opening configured to receive the conductor, the first sidewall defining serrations on a side thereof opposite the opening in an uncrimped state of the terminal, and wherein in a crimped state of the terminal, the first section and second sections of the first sidewall are rotated into the opening with the first section at least partially surrounding the second section for crimping the conductor within the opening and between the serrations and the protrusion.

2. The electrical terminal of claim 1, wherein the second sidewall comprises a first section and a second section opposing the first and second sections of the first sidewall, respectively, wherein in a crimped state, the first sidewall is rotated relative to the base in a first direction and into the opening, and the second sidewall is rotated into the opening in a direction opposite to the first direction such that the first section of the second sidewall at least partially surrounds the second section of the second sidewall.

3. The electrical terminal of claim 2, wherein in the crimped state, the second sections of the first and second sidewalls are rotated at least 270 degrees from an angular orientation relative to the base in an uncrimped state of the terminal, each of the second sections being wound within a respective one of the first sections.

4. The electrical terminal of claim 2, wherein first section of the first sidewall extends from the base in a direction extending away from the opening, and the second section of the first sidewall comprises a curved profile extending from an end of the first section and in a direction toward the opening.

5. The electrical terminal of claim 4, wherein an axis of curvature of the second section of the first sidewall extends in the longitudinal direction of the terminal.

6. The electrical terminal of claim 1, wherein the second section of the first sidewall tapers in thickness from the first section to a free end thereof.

7. The electrical terminal of claim 1, wherein the protrusion comprises a curved profile having an axis of curvature extending in the longitudinal direction of the terminal.

8. The electrical terminal of claim 7, wherein the protrusion comprises:

first and second end protrusions;

a central protrusion arranged between the first and second end protrusions;

a first intermediate protrusion arranged between the first end protrusion and the central protrusion; and a second intermediate protrusion arranged between the second end protrusion and the central protrusion, wherein the first and second intermediate protrusions extend further into the opening than the first and second end protrusion and the central protrusion.

9. A cable assembly comprising:

a flat flexible cable including a plurality of conductors embedded within an insulation material, wherein a portion of each of the conductors is exposed via openings selectively formed in the insulation material; and a plurality of electrically conductive terminals, each of the terminals having a crimping portion at least partially engaging with the openings in the insulation material and receiving the exposed portion of a respective conductor, the crimping portion including:

a base defining at least one protrusion extending along the base in a longitudinal direction of the terminal, the protrusion having a curved profile with an axis of curvature extending in the longitudinal direction of the terminal therefrom;

a first sidewall extending from the base and comprising a first section attached to the base and a second section attached to the first section on an end opposite the base; and a second sidewall extending from the base, the base and first and second sidewalls defining an opening configured to receive the conductor, wherein, in a crimped state of the terminal, the first section and second section of the first sidewall are rotated into the opening for crimping the conductor within the opening and against the protrusion, the first section at least partially surrounding the second section.

10. The cable assembly of claim 9, wherein at least one of the first sidewall or the second sidewall defines serrations on a side thereof opposite the opening in an uncrimped state of the terminal, wherein in the crimped state of the terminal the conductor is crimped between the serrations and the protrusion.

11. The cable assembly of claim 10, wherein the second sidewall comprises a first section and a second section opposing the first and second sections of the first sidewall, respectively, wherein in a crimped state, the first sidewall is rotated relative to the base in a first direction and into the opening and the second sidewall is rotated into the opening in a direction opposite to the first direction such that the first section of the second sidewall at least partially surrounds the second section of the second sidewall.

12. The cable assembly of claim 11, wherein in the crimped state, the second sections of the first and second sidewalls are rotated at least 270 degrees from an angular orientation relative to the base in an uncrimped state of the terminal, each of the second sections being wound within a respective one of the first sections.

13. The cable assembly of claim 10, wherein the first section of the first sidewall extends from the base in a direction extending away from the opening, and the second section of the first sidewall comprises a curved profile extending in a direction toward the opening.

14. The cable assembly of claim 13, wherein an axis of curvature of the second section of the first sidewall extends in the longitudinal direction of the terminal.

15. The cable assembly of claim 14, wherein the second section of the first sidewall tapers in thickness from the first section to a free end thereof.

16. An electrical terminal for mating with an exposed conductor of a flat flexible cable, comprising:

an electrical contact; and a crimping portion extending from the electrical contact in a longitudinal direction of the terminal for crimping to the conductor of the flat flexible cable, the crimping portion including:

a base defining at least one protrusion extending therefrom;

a first sidewall extending from the base and comprising a first section attached to the base and a second section attached to the first section on an end opposite the base; and a second sidewall extending from the base, the base and the first and second sidewalls defining an opening configured to receive the conductor, the first section of the first sidewall extending away from the opening, and the second section of the first sidewall tapering in thickness between the first section and a free end thereof, wherein in a crimped state of the terminal, the first section and second section of the first sidewall are rotated into the opening for crimping the conductor within the opening and against the protrusion, the first section at least partially surrounding the second section.

17. The electrical terminal of claim 16, wherein the protrusion extends along the base in the longitudinal direction of the terminal.

18. The electrical terminal of claim 16, wherein the second section of the first sidewall defines a curved profile extending in a direction toward the opening, and an axis of curvature of the second section of the first sidewall extends in the longitudinal direction of the terminal.

19. The electrical terminal of claim 18, wherein at least one of the first sidewall or the second sidewall defines serrations on a side thereof opposite the opening in an uncrimped state of the terminal, wherein in the crimped state of the terminal the conductor is crimped between the serrations and the protrusion.

20. The electrical terminal of claim 16, wherein the protrusion comprises:

first and second end protrusions;

a central protrusion arranged between the first and second end protrusions;

a first intermediate protrusion arranged between the first end protrusion and the central protrusion; and a second intermediate protrusion arranged between the second end protrusion and the central protrusion, wherein the first and second intermediate protrusions extend further into the opening than the first and second end protrusion and the central protrusion.

* * * * *